US008821059B2

(12) United States Patent
Sasaki et al.

(10) Patent No.: US 8,821,059 B2
(45) Date of Patent: Sep. 2, 2014

(54) COSMETIC CONTAINER

(75) Inventors: Arata Sasaki, Kawaguchi (JP); Tomonari Sato, Kawaguchi (JP)

(73) Assignee: Tokiwa Corporation, Nakatsugawa-Shi, Gifu (JP)

( * ) Notice: Subject to any disclaimer, the term of this patent is extended or adjusted under 35 U.S.C. 154(b) by 586 days.

(21) Appl. No.: 13/113,199

(22) Filed: May 23, 2011

(65) Prior Publication Data

US 2011/0299911 A1 Dec. 8, 2011

(30) Foreign Application Priority Data

Jun. 7, 2010 (JP) ..... 2010-130045
Sep. 1, 2010 (JP) ..... 2010-195883

(51) Int. Cl.
*A45D 33/34* (2006.01)
*A45D 33/02* (2006.01)

(52) U.S. Cl.
CPC ..... *A45D 33/02* (2013.01); *A45D 2200/1009* (2013.01); *A45D 32/04* (2013.01)
USPC ..... 401/263; 401/205; 401/132; 401/133; 401/134; 401/135

(58) Field of Classification Search
USPC ..... 401/132, 133, 134, 135, 176, 204, 205, 401/219, 263, 270
See application file for complete search history.

(56) References Cited

U.S. PATENT DOCUMENTS

| | | | | |
|---|---|---|---|---|
| 3,802,604 | A * | 4/1974 | Morane et al. | 222/83 |
| 5,609,581 | A * | 3/1997 | Fletcher et al. | 604/212 |
| 6,488,665 | B1 * | 12/2002 | Severin et al. | 604/200 |
| 6,817,802 | B2 * | 11/2004 | Nishitani et al. | 401/235 |
| 6,905,277 | B2 * | 6/2005 | Saito et al. | 401/281 |
| 7,314,329 | B1 * | 1/2008 | Byun | 401/279 |
| 7,396,180 | B2 * | 7/2008 | Bugla et al. | 401/265 |
| 7,648,296 | B2 * | 1/2010 | Wong | 401/134 |
| 7,722,277 | B2 * | 5/2010 | Byun | 401/280 |
| 2006/0018701 | A1 * | 1/2006 | Mohiuddin | 401/132 |
| 2006/0039742 | A1 * | 2/2006 | Cable et al. | 401/134 |
| 2006/0140708 | A1 * | 6/2006 | Byun | 401/270 |
| 2013/0251439 | A1 * | 9/2013 | Guzman | 401/132 |

* cited by examiner

*Primary Examiner* — David Walczak
*Assistant Examiner* — Joshua Wiljanen
(74) *Attorney, Agent, or Firm* — Bacon & Thomas, PLLC

(57) ABSTRACT

To make a cosmetic container convenient, a closing part 6*b* of a discharge cylinder 6 closes an insertion hole 2*h* of a middle cylinder part 2 and seals a cosmetic A when a moving part 3 is positioned at a first stopping position, the discharge cylinder 6 protrudes by a predetermined length from an end face of the insertion hole 2*h* and slits 6*c* of the discharge cylinder 6 are exposed when the moving part 3 is moved from the first stopping position to a second stopping position separating in an axial direction, so that a user can visually confirm that the cosmetic can flow out through the slits 6*c*, the discharge cylinder and a discharge cylinder opening part 6*a*, and the moving part 3 is left at the second stopping position, so that the cosmetic A can securely flow out without variation when in use.

9 Claims, 10 Drawing Sheets

COSMETIC CONTAINER

BACKGROUND OF THE INVENTION

1. Field of the Invention

The present invention relates to a cosmetic container, which can seal a cosmetic inside thereof when not in use and flow the cosmetic to the outside to be applied when in use.

2. Description of the Conventional Art

A conventionally known cosmetic container includes a container main body and a lid part. The container main body houses a cosmetic. The lid part is mounted on an upper part of the container main body so as to cover it, and has an opening to make the cosmetic housed in the container main body to flow to the outside to be used. The cosmetic container further includes an inner lid for sealing the cosmetic in the container main body to maintain virginity of the cosmetic in the container main body. In such a cosmetic container, it is necessary that after the lid part is removed from the upper part of the container main body at the beginning of initial use, the inner lid is removed, and the lid part is remounted on the container main body. Thus, this operation is troublesome, and there is a problem in operability.

Accordingly, the Japanese Patent Application Laid-Open No. 2008-259636 discloses a technique for a powdery cosmetic container. In this cosmetic container, a valve body is provided instead of the inner lid. A puff of the cosmetic container is patted and pushed, while being contacted with a skin of a user, to thereby separate the valve body from a valve seat member and open a valve hole. The powdery cosmetic passes through the opening valve hole and is discharged to the outside through the puff. On the other hand, when the user separates the puff from the skin, the valve body is moved in the axial direction of the container, shuts the valve hole, and seals the container main body, to thereby prevent the powdery cosmetic from being discharged to the outside.

Furthermore, the Japanese Patent No. 4321909 discloses a technique for a liquid applicator. In the liquid applicator, a connection hole of a partition part is closed by using a seal ball instead of the inner lid and seals a coating liquid. When a joining part is moved to the side of a main body axis, a rear end connection part extrudes the seal ball from the connection hole, so that the coating liquid can be discharged to the outside.

SUMMARY OF THE INVENTION

Problems to be Solved by the Invention

However, in the powdery cosmetic container described in the Japanese Patent Application Laid-Open No. 2008-259636, the valve hole is opened only when patting or pushing the puff. Thus, the valve hole is not opened sufficiently depending on how to use it, and the amount of the cosmetic to be discharged is varied. Further, when the cosmetic is not discharged to the outside at a time of using the powdery cosmetic container, it is difficult for a user to determine whether the way to use is incorrect or the valve hole is not opened normally.

Further, in the liquid applicator described in Japanese Patent No. 4321909, it is frequently conceivable that the extruded seal ball is moved to the vicinity of the connection hole at a time of using the liquid applicator. In such a case, the seal ball comes to be just an obstacle which prevents flowing of a coating liquid when discharging the coating liquid from the connection hole to the outside through a coating liquid discharge hole. Thus, the liquid applicator has a configuration which is inconvenient for discharging the coating liquid stably and securely.

Therefore, an objective of the present invention is to provide a cosmetic container, which can seal a cosmetic housed in the container when not in use and make a user to visually confirm a condition that the cosmetic is flowable to the outside when in use. In addition, the cosmetic container can make the cosmetic to securely flow out to the outside of the container without variation of the flowing amount of the cosmetic.

Means for Solving the Problem

According to an aspect of the present invention, a cosmetic container is configured with a container main body, a moving part, a middle cylinder part, and an application body. The container main body houses a cosmetic. The moving part includes a cylindrical discharge cylinder, which has an opening part opened at one end in an axial direction, a closing part closed at the other end in the axial direction, and slits in the side face. The cosmetic housed in the container main body can be discharged from the opening part, after passing through the slit. The middle cylinder part includes an insertion hole into which the discharge cylinder can be inserted, and an application body which covers the opening part of the discharge cylinder and can make the cosmetic to flow out to the outside. The moving part has a configuration that, in a state of the discharge cylinder being inserted into the insertion hole of the middle cylinder part, the moving part can be moved from a first stopping position to a second stopping position separating in the axial direction, and is left at the second stopping position. When the moving part is positioned at the first stopping position, the closing part of the discharge cylinder closes the insertion hole of the middle cylinder part. When the moving part is positioned at the second stopping position, the discharge cylinder protrudes by a predetermined length from an end face of the insertion hole, so that the cosmetic can be discharged to the application body from the opening part, after passing through the slits in the side face of the discharge cylinder.

According to such the cosmetic container, when the moving part is positioned at the first stopping position, the closing part of the discharge cylinder closes the insertion hole of the middle cylinder part and seals a cosmetic A. When the moving part is moved from the first stopping position to the second stopping position separating in the axial direction, the discharge cylinder protrudes by a predetermined length from the end face of the insertion hole and exposes the slit of the discharge cylinder. Thus, a user can visually confirm the condition that the cosmetic can flow out to the outside through the slits, the inside of the discharge cylinder, and the opening part. Further, since the moving part is left at the second stopping position, the cosmetic can flow without variation when in use, so that the cosmetic can securely flow out to the outside of the container.

As a configuration effectively giving the aforementioned effect, the following particular configuration can be described. At the second stopping position, the moving part abuts against the container main body and comes to be unmovable toward the container main body side. In addition, the moving part engages with the middle cylinder part in the axial direction and comes to be unmovable to the side opposite to the container main body side. As a result, the moving part is left at the second stopping position.

More particularly, in the configuration, the discharge cylinder has pawl parts on an outer peripheral face thereof. The pawl parts are bent inside when the moving part is moved to the second stopping position. When the moving part is positioned at the second stopping position, the pawl parts elastically return to the original position and are hooked onto a bottom face of the middle cylinder part. Accordingly, the moving part is engaged in the axial direction and is unmovable to the side opposite to the container main body side.

Further, as another configuration effectively giving the aforementioned effect, the particular configuration is as follows. The cosmetic container further includes a stopper which is detachably mounted so as to be inserted between the moving part and the container main body in the axial direction. Since the stopper is mounted, the moving part is unmovable to the container main body side, and can be left at the first stopping position.

Furthermore, the following configuration is preferable. The moving part includes a moving part-side rotation stopper. In addition, the middle cylinder part includes a middle cylinder part-side rotation stopper. By the moving part-side rotation stopper and the middle cylinder-side rotation stopper, the moving part engages with the middle cylinder part so as to be unrotatable in the peripheral direction. When such a configuration is adopted, the moving part and the middle cylinder part are integrated in a rotation direction. Thus, for example, even if the cosmetic container has a configuration that a cap covering the cosmetic container is mounted to the moving part and has a configuration that the moving part includes a male screw screwing to a female screw of the cap, the moving part and the middle cylinder are not synchronously rotated with the cap, so that the cap can be easily removed from the cosmetic container.

Effect of the Invention

As mentioned above, according to the present invention, the following cosmetic container can be provided. The cosmetic container can seal a cosmetic housed in the container when not in use. When in use, a user can visually confirm the condition that the cosmetic is flowable to the outside. In addition, the cosmetic container can make the cosmetic to securely flow out to the outside of the container without variation of the flowing amount of the cosmetic.

DETAILED DESCRIPTION OF PREFERRED EMBODIMENT

Figure 7:
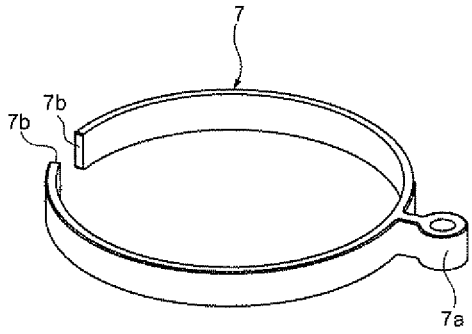
FIG. 7 is a perspective view illustrating a stopper removed from the cosmetic container illustrated in FIG. 1.
Figure 8:
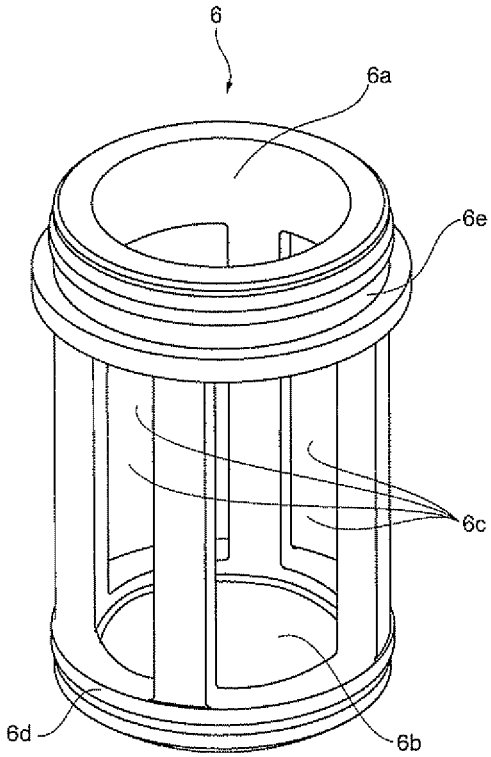
FIG. 8 is a perspective view illustrating a discharge cylinder in FIGS. 5 and 6.
Figure 9:
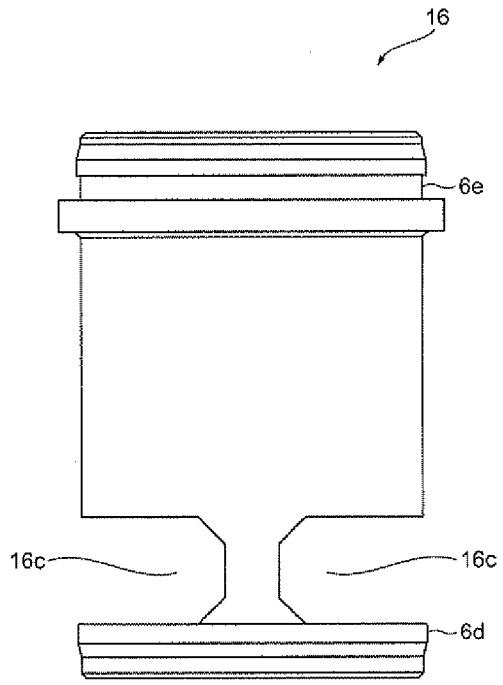
FIG. 9 is a front view illustrating a discharge cylinder of a cosmetic container according to a second exemplary embodiment of the present invention.
Figure 10:
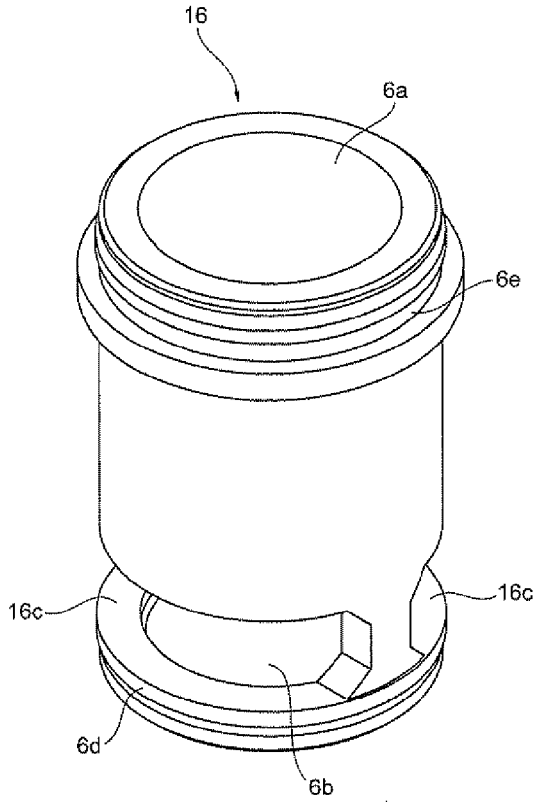
FIG. 10 is a perspective view of the discharge cylinder illustrated in FIG. 9 as viewed from the obliquely upper-left side.
Figure 11:
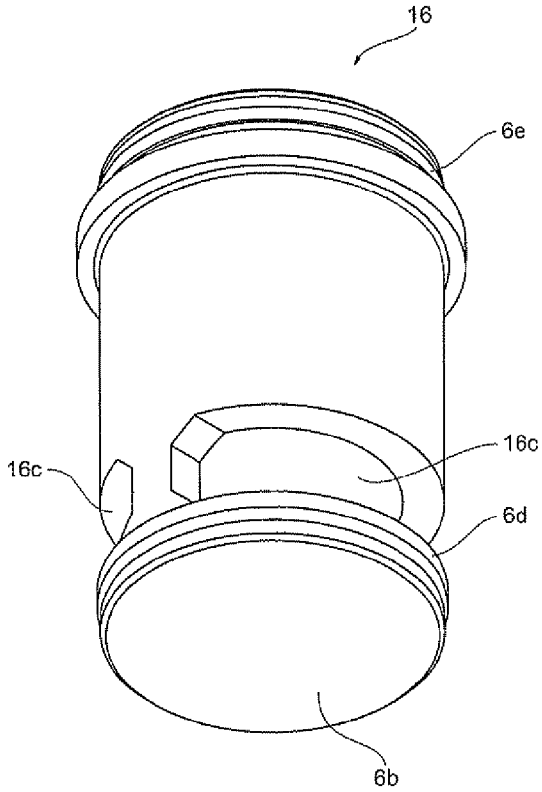
FIG. 11 is a perspective view of the discharge cylinder illustrated in FIG. 9 as viewed from the obliquely lower-right side.

Preferred embodiments of the cosmetic container according to the present invention will be described below with reference to FIGS. 1 to 18. FIGS. 1 to 8 illustrate a first exemplary embodiment of the present invention respectively. FIGS. 9 to 11 illustrate a second exemplary embodiment of the present invention respectively. FIGS. 12 to 18 illustrate a third exemplary embodiment of the present invention respectively. In each figure, the same reference numerals are used to the same parts, and repeated descriptions are omitted.

Figure 1:
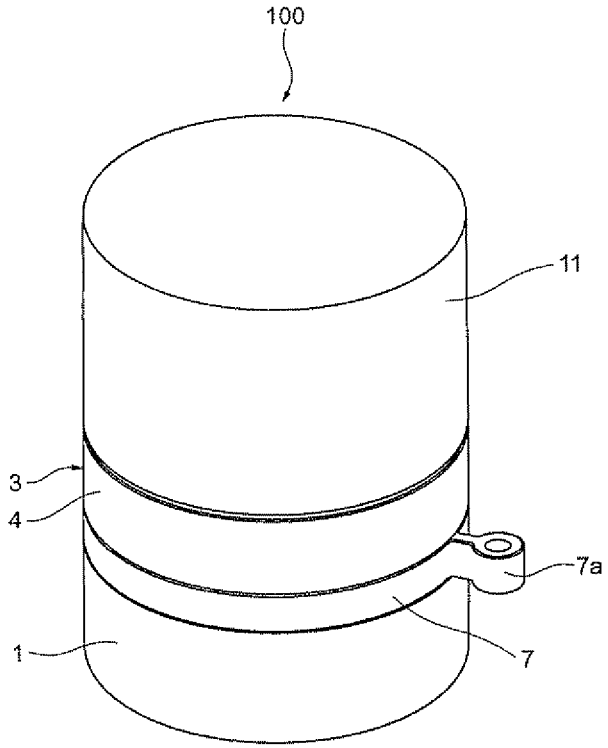
FIG. 1 is an appearance view illustrating a cosmetic container according to a first exemplary embodiment of the present invention, and is a perspective view illustrating a state that a cap and a stopper are mounted.
Figure 2:
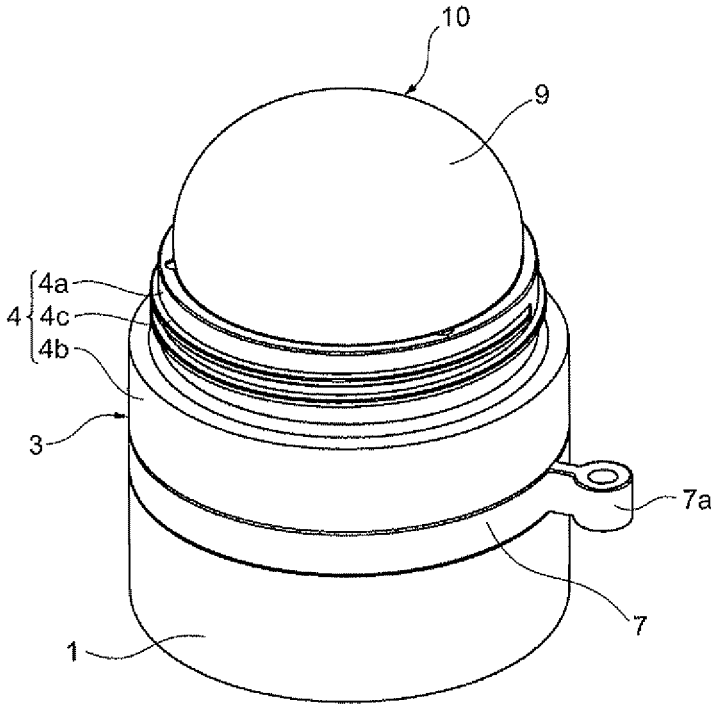
FIG. 2 is a perspective view illustrating a state that the cap is removed from the state in FIG. 1.
Figure 3:
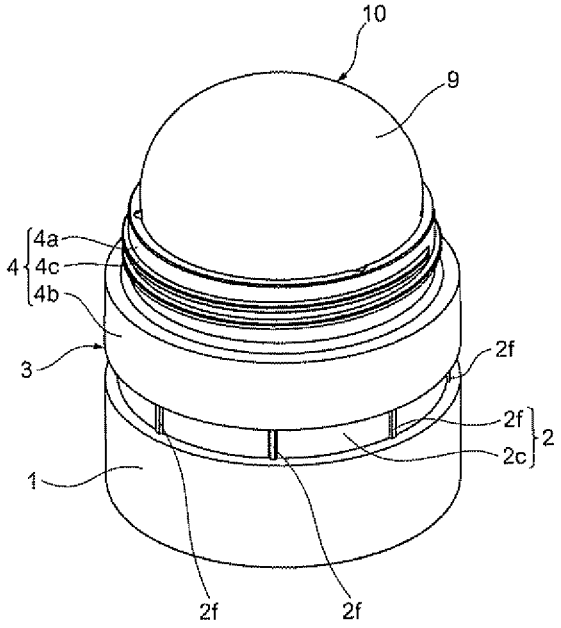
FIG. 3 is a perspective view illustrating a state that a cap and a stopper are removed from the state in FIG. 1.
Figure 4:
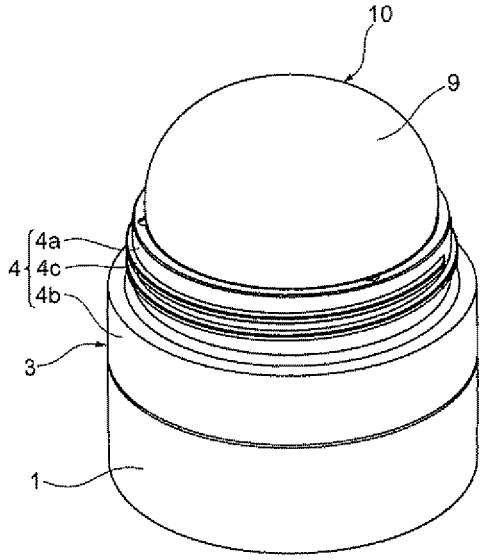
FIG. 4 is a perspective view illustrating a state that a moving part is moved to a second stopping position from the state in FIG. 3.
Figure 5:
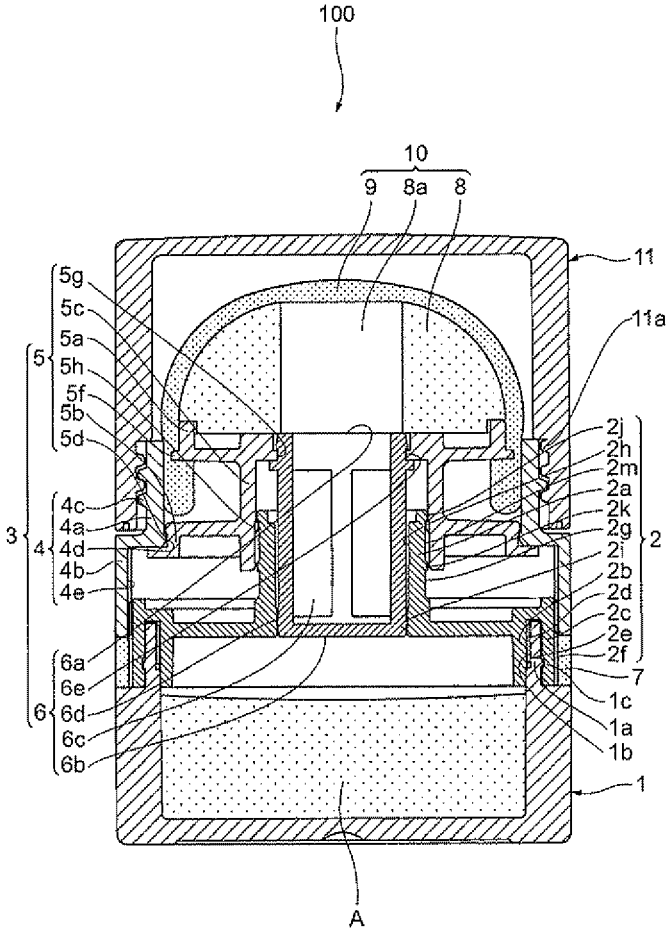
FIG. 5 is a longitudinal sectional view of the cosmetic container illustrated in FIG. 1.
Figure 6:
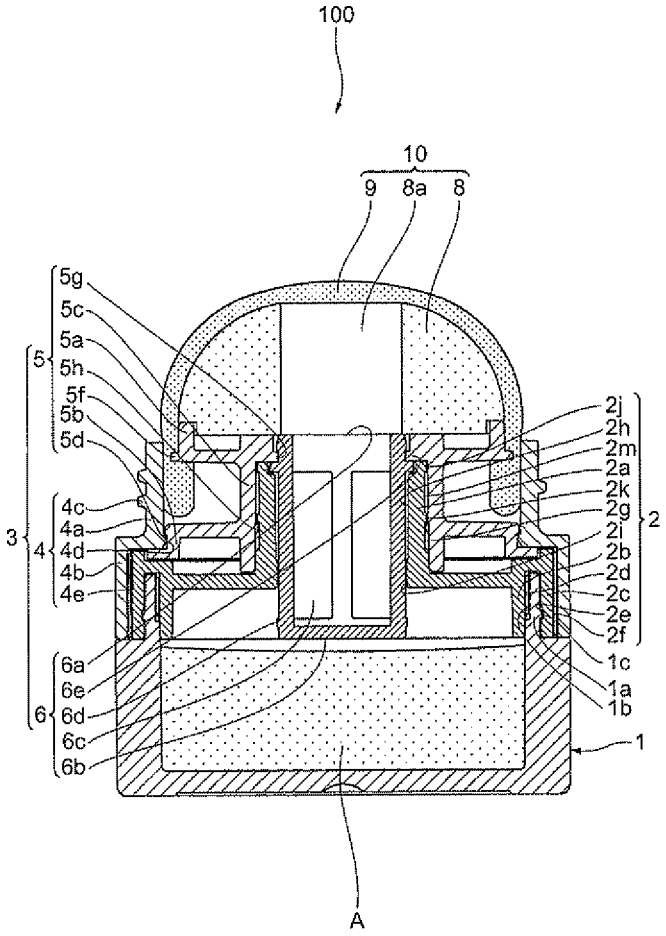
FIG. 6 is a longitudinal sectional view of the cosmetic container illustrated in FIG. 4.

First of all, the first exemplary embodiment illustrated in FIGS. 1 to 8 will be described. FIG. 1 is a perspective view illustrating a cosmetic container according to the first exemplary embodiment of the present invention. FIG. 2 is a perspective view illustrating a state that a cap is removed from the state in FIG. 1. FIG. 3 is a perspective view illustrating a state that a cap and a stopper are removed from the state in FIG. 1. FIG. 4 is a perspective view illustrating a state that a moving part is moved to a second stopping position from the state in FIG. 3. FIGS. 5 and 6 are longitudinal sectional views respectively illustrating cosmetic containers when in not use and when in use. FIG. 7 is a perspective view illustrating a stopper. FIG. 8 is a perspective view illustrating a discharge cylinder. The cosmetic container of the present exemplary embodiment is used, for example, when a user applies a powdery cosmetic to a skin of a face or the like. In addition, in the present exemplary embodiment, the cosmetic is described as powder. However, the cosmetic can be liquid, and cosmetic state is not limited if it can be applied to the present invention.

As illustrated in FIGS. 1 to 6, a cosmetic container 100 includes a container main body 1, a middle cylinder part 2, a moving part 3, a stopper 7, an application body 10 and a cap 11. The container main body 1 houses a cosmetic A. The middle cylinder part 2 is arranged on the upper part of the container main body 1 and has a cylinder hole communicating with the inside of the container main body 1. The moving part 3 has a cylinder part inserted into the cylinder hole of the middle cylinder part 2 and is movable in the axial direction within a fixed section. The stopper 7 is detachably mounted on the outer peripheral face of the middle cylinder part 2 so as to be inserted between the container main body 1 and the moving part 3, and prevents the moving part 3 from being moved downward in the axial direction. The application body 10 is mounted on the moving part 3 so that the cosmetic A can flow to the outside. The cap 11 is detachably mounted on the moving part 3.

As illustrated in FIG. 5, the container main body 1 is configured to have a bottomed cylindrical shape to house the cosmetic A therein. The container main body 1 includes a protrusion part 1*a* at an upper part thereof. The protrusion part 1*a* is thinner than a lower part of the container main body 1 and cylindrically protrudes upward. A knurling 1*b*, in which concavo-convex parts are densely provided in parallel along the peripheral direction, is provided on the inner peripheral face of the protrusion part 1*a*, for connecting the middle cylinder part 2 to the container main body 1 so as to be unrotatable in the peripheral direction. Further, a circular convex part 1*c* is provided on the outer peripheral face of the protrusion part 1*a*, for connecting the middle cylinder part 2 to the container main body 1 so as to be unmovable in the axial direction. In addition, a part or the entirety of the container main body 1 can be transparent so as to enable to see the cosmetic A inside.

The middle cylinder part 2 is configured by connecting a cylindrical part 2*a*, an inner cylindrical part 2*b*, and an outer cylindrical part 2*c* with an annular flat plate part. The cylindrical part 2*a* has a small diameter and extends upward, and the inner cylindrical part 2*b* and the outer cylindrical part 2*c* have large diameters and extend downward. On the outer peripheral face of the inner cylindrical part 2*b*, a plurality of ridges 2*d* engaging with the knurling 1*b* of the container main body 1 are provided in the peripheral direction. On the inner peripheral face of the outer cylindrical part 2*c*, a circular concave part 2*e* for fitting the annular convex part 1*c* of the container main body 1 is provided. That is, the middle cylinder part 2 is connected with the container main body 1 so as to be unrotatable in the peripheral direction and unmovable in the axial direction. Further, on the outer peripheral face of the outer cylindrical part 2*c*, a plurality of middle cylinder side rotation stoppers 2*f* having a convex shape and extending in the vertical direction are provided in the peripheral direction. These stoppers are for connecting the middle cylinder 2 and the moving part 3 (an outer moving body 4) so as to be unrotatable in the peripheral direction.

Further, in the cylindrical part 2*a* of the middle cylinder part 2, an inner peripheral face thereof is made to be a communication hole 2*h* communicating to the inside of the container main body 1. The communication hole 2*h* comes to be an insertion hole in which a discharge cylinder 6 of the moving part 3, which will be described below, can be inserted. Further, on an outer peripheral face of the cylindrical part 2*a*, a circular convex part 2*k* is formed around an intermediate position between the upper part and the lower part of the cylindrical part 2*a*. Circular concave parts 2*m* and 2*g* extending in the vertical direction are formed at both the upper side and the lower side of this convex part 2*k*. More upper side than the upper concave part 2*m* is made to be a stepped part 2*j* which has an approximately equal outer diameter to the convex part 2*k* and has a larger inner diameter than the communication hole 2*h*. The stepped part 2*j* limits an upward movement in the axial direction (prevents separation) of the moving part 3 (the inner moving body 5) when the moving part 3 is positioned at the first position illustrated in FIG. 5. In addition, the convex part 2*k* limits the upward movement in the axial direction (prevents separation) of the moving part 3 (the inner moving body 5) when the moving part 3 is positioned at the second position illustrated in FIG. 6. Furthermore, as illustrated in FIG. 5, a receiving part 2*i*, to which a seal part 6*d* is contacted, is provided at a lower part of the inner periphery face of the cylindrical part 2*a*. The seal part 6*d* is provided on the outer peripheral face of the discharge cylinder 6 of the moving part 3, which will be described below. The inner diameter of the receiving part 2*i* at the lower part of the communication hole 2*h* is made to be smaller than the inner diameter of the upper portion of the communication hole.

The moving part 3 is configured with an outer moving body 4 positioned at the outer side, an inner moving body 5 positioned on the inner side of the outer moving body 4, and a discharge cylinder 6 positioned on the inner side of the inner moving body 5. In the present exemplary embodiment, these moving bodies can be moved identically in the axial direction.

The outer moving body 4 includes an upper cylindrical part 4*a* having a small diameter at an upper part thereof, and a lower cylindrical part 4*b* having a large diameter at a lower part thereof. On an outer peripheral face of the upper cylindrical part 4*a*, a male screw 4*c* for mounting a cap 11 is provided. Further, on the lower side of an inner peripheral face of the upper cylindrical part 4*a*, a circular protrusion part 4*d* is provided. The protrusion part 4*d* is provided for fitting the inner moving body 5 to be unmovable in the axial direction. Further, on an inner peripheral face of the lower cylindrical part 4*b*, a moving part-side rotation stopper 4*e* which is a knurling is provided. The knurling has concavo-convex parts densely provided in parallel along the peripheral direction, and engages with the middle cylinder part rotation stopper 2*f* of the middle cylinder part 2. With this configuration, the outer moving body 4 (the moving part 3) and the middle cylinder part 2 are connected to be unrotatable in the peripheral direction.

In addition, in the present exemplary embodiment, the moving part-side rotation stopper 4*e* is provided as the knurling, and the middle cylinder part rotation stopper 2*f* has a convex shape capable of engaging with the moving part-side rotation stopper 4*e*. However, the moving part-side rotation stopper 4*e* and the middle cylinder part rotation stopper 2*f* can have shapes other than those of the present exemplary embodiment if the moving part 3 can be connected with the middle cylinder part 2 so as to be unrotatable in the peripheral direction.

The inner moving body 5 is configured with an upper part 5*a* having a concave shape and an inverted concave-shaped lower part 5*b*, where the upper part 5*a* and the lower part 5*b* have large diameters. In addition, the inner moving body 5 has a cylindrical intermediate part 5*c*, which connects the upper part 5*a* and the lower part 5*b* on the inner peripheral sides of those, and has a smaller diameter. The upper part 5*a* has a shape capable of holding a part or the entirety of a bottom part of an elastic part of the application body 10, which will be described below, from the outer side in the radial direction. Further, the upper part 5*a* has a flange part 5*f* on an outer peripheral face thereof, and has a circular protrusion part 5*g* on an inner peripheral face thereof, where the protrusion part 5*g* is provided for fitting the discharge cylinder 6 to be unmovable in the axial direction. Further, the lower part 5*b* has a fitting part 5*d* on an outer peripheral face thereof. The fitting part 5*d* can fit to the protrusion part 4*d* of the outer moving body 4. By fitting the fitting part 5*d* to the protrusion part 4*d*, the inner moving body 5 and the outer moving body comes to be unmovable in the axial direction. The intermediate part 5*c* has a protrusion part 5*h* on an inner peripheral face. By contacting of the convex part 5*h* to a stepped part 2*j* of the middle cylinder part 2 from the lower side, the inner moving body 5 (the moving part 3) cannot be moved upward from the first stopped position. Furthermore, as illustrated in FIG. 6, the convex part 5*h* gets over the convex part 2*k* of the middle cylinder part 2, enters into the concave part 2*g*, and is in contact with the convex part 2*k* from the lower side, so that the inner moving body 5 (the moving part 3) cannot be moved upward from the second stopping position.

As illustrated in FIG. 8, the discharge cylinder 6 has a cylindrical shape, has an outer diameter which can be inserted into the insertion hole 2*h* of the middle cylinder part 2, and is inserted into the insertion hole 2*h* (refer to FIG. 5). Further, the discharge cylinder 6 has an opening part 6*a* opened at one end (upper end), and a bottom face part (closing part) 6*b* closed at the other end (lower end). Furthermore, the discharge cylinder 6 has slits 6*c* (four slits in the present exemplary embodiment) which are provided in parallel in the side face thereof and can pass the cosmetic A. The slits 6*c* are configured to be an approximately rectangular shape which is vertically long in a side view and extends from the lower part to the upper part. Further, as illustrated in FIG. 5, the discharge cylinder 6 has a fitting part 6*e* provided at an upper part on an outer peripheral face thereof. The fitting part 6*e* is fitted to the protrusion part 5*g* of the inner moving body 5 so as to be unmovable in the axial direction. The discharge cylinder 6 has a seal part 6*d* provided at a lower part on the outer peripheral face, and the seal part 6*d* is in contact with the receiving part 2*i* of the middle cylinder part 2. The outer diameter of the seal part 6*d* of the discharge cylinder 6 is approximately equal to the inner diameter of the receiving part 2*i* of the middle cylinder part 2. The receiving part 2*i* and the seal part 6*d* are pressed-in and fitted, so that the cosmetic A cannot pass through between the receiving part 2*i* and the seal part 6*d*.

The moving part 3 is configured as follows. As described above, the protrusion part 4*d* is fitted to the fitting part 5*d*, so that the outer moving body 4 and the inner moving body 5 are fitted to be unmovable in the axial direction. In addition, the protrusion part 5*g* is fitted to the fitting part 6*e*, so that the inner moving body 5 and the discharge cylinder 6 are fitted to be unmovable in the axial direction. Accordingly, the outer moving body 4, the inner moving body 5, and the discharge cylinder 6 are configured to be able to identically move in the axial direction.

Accordingly, it is herein called that the moving part 3 is positioned at the first stopping position, when the moving part 3 is in the state that the discharge cylinder 6 of the moving part 3 is inserted into the insertion hole 2*h*, the receiving part 2*i* and the seal part 6*d* are fitted so that the bottom face part 6*b* of the discharge cylinder 6 comes to be approximately flush with the bottom face (end face) of the insertion hole 2*h* without protruding downward from there, and the convex part 5*h* is in contact with the stepped part 2*j* (there may be some spaces between those).

Furthermore, as illustrated in FIG. 6, when the moving part 3 is moved downward in the axial direction, and the convex part 5*h* gets over the convex part 2*k* to enter into the concave part 2*g*, the discharge cylinder 6 protrudes downward by a predetermined length from the bottom face of the insertion hole 2*h*, and the slits 6*c* are exposed from the insertion hole 2*h*. It is herein called that the moving part 3 is positioned at the second stopping position, when the moving part 3 is in the state that the discharge cylinder 6 protrudes by a predetermined length as mentioned above.

As illustrated in FIGS. 1, 2 and 5, the stopper 7 is mounted on the cosmetic container 100 so as to surround the outer periphery of the outer cylindrical part 2*c* of the middle cylinder part 2 and be inserted between the outer moving body 4 and the container main body 1 in the axial direction. The stopper 7 has a circular shape when being mounted on the cosmetic container 100, and has a handle 7*a* on an outer peripheral face thereof. In addition, the stopper 7 has a joining part 7*b* (refer to FIG. 7) at a position being preferably opposite to the handle 7*a*. The joining part 7*b* is separated when predetermined force is applied to it. As for the joining part 7*b* of the stopper 7, for example, when the stopper 7 is mounted on the cosmetic container 100, a user holds the handle 7*a* and pulls it in a horizontal direction to the axial line of the cosmetic container 100, so that the joining part 7*b* is separated, and thereby the user can remove the stopper 7 from the cosmetic container 100.

FIG. 7 illustrates the stopper 7 of which the joining part 7*b* is separated. In FIG. 7, the joining part 7*b* is provided at the position opposite to the handle 7*a* when the stopper 7 has the circular shape. In addition, the position for providing the joining part 7*b* is not limited especially. If the joining part 7*b* can be separated when a user holds the handle 7*a* and applies force in the horizontal direction, the joining part 7*b* can be provided at any position of the circular stopper 7.

Further, as illustrated in FIGS. 1, 2 and 5, the stopper 7 is inserted between the outer moving body 4 and the container main body 1 in the axial direction, and mounted on the cosmetic container 100. Accordingly, the moving part 3 cannot be moved downward in the axial direction (cannot be moved to the side of the container main body). In addition, the moving part 3 is unmovable upward in the axial direction by engaging of the convex part 5*h* with the stepped part 2*j* in the axial direction as described above, so that the moving part 3 can be left at the first stopping position.

As illustrated in FIGS. 2 to 6, the application body 10 is configured with an elastic part 8 and an applicator 9. The elastic part 8 has a hemispherical outer face expanding to the outside. The elastic part 8 is configured with an elastic material made of a porous material in which the cosmetic A can pass through, e.g., urethane foam, NBR, and the like. As illustrated in FIGS. 5 and 6, the elastic part 8 includes an outflow hole 8*a* approximately in the center as a hole provided for communicating between the opening part 6*a* of the discharge cylinder 6 and the applicator 9. The outflow hole 8*a* is a main passage for making the cosmetic A to flow out to the outside.

Further, the elastic part 8 is put on the inner moving body 5 so as to come to be at a position where the outflow hole 8*a* communicates with the opening part 6*a* of the discharge cylinder 6. Further, in this state, a part or the entirety of the bottom part of the elastic part 8 is inserted into the inner side in the radial direction of the upper part 5*a* of the inner moving body 5. In the elastic part 8 put as aforementioned, the cosmetic A passing through the opening part 6*a* of the discharge cylinder 6 can flow out to the outside, mainly through the outflow hole 8*a*. However, since the elastic part 8 is made of the porous material, the cosmetic A can flow out from parts other than the outflow hole ea.

The applicator 9 is provided for applying the cosmetic A flowing out through the elastic part 8 with a good application feeling to a skin, and has a hemispherical outer face expanding to the outside like the elastic part 8. In the applicator 9, a lower part of the hemispherical shape is inserted between a outer peripheral surface of the flange part 5*f* of the inner side moving body 5 and an inner peripheral surface of the upper cylinder part 4*a* of the outside moving body 4, so as to contact closely with the outside of the elastic part 8. With this configuration, the applicator 9 and elastic part 8 are mounted to the moving part 3.

The applicator 9 is configured with an elastic body made of a porous material in which the cosmetic A can pass through, e.g., urethane foam, NBR, and the like, like the elastic part 8. Further, the applicator 9 is made by applying flocking to one surface of a sponge, puff, or the like made of the porous material.

The application body 10 configured as described above can make the cosmetic to flow out to the outside and apply the cosmetic A to a skin, or the like, as a surface to be applied. Further, the application body 10 is mounted on the moving part 3. Thus, when the moving part is moved in the axial direction, the application body 10 is moved identically with the moving part 3.

As illustrated in FIGS. 1 and 5, the cap 11 is a cylindrical lid having a closed upper part. The cap 11 includes a female screw 11*a* on an inner peripheral face thereof, and the female screw 11*a* is screwed to the male screw 4*c* of the outer moving body 4. The cap 11 is mounted on the moving part 3 by screwing the female screw 11*a* to the male screw 4*c*.

Before the cosmetic container 100 configured as described above starts to be used, the stopper 7 is mounted at first as illustrated in FIGS. 1, 2 and 5, and the moving part 3 is made unmovable downward in the axial direction by the stopper 7 and unmovable upward in the axial direction by the convex part 5*h* and the stepped part 2*j*, so that the moving part is left at the first stopping position.

In the first stopping position, the seal part 6*d* of the discharge cylinder 6 of the moving part 3 is fitted to the receiving part 2*i* of the cylindrical part 2*a* of the middle cylinder part 2, and the cosmetic A cannot pass through between those. Further, since the closed bottom face part 6*b* of the discharge cylinder part 6 does not protrude downward from the bottom face of the insertion hole 2*h*, the cosmetic A housed in the container main body 1 cannot pass through the inside of the insertion hole 2*h* or the discharge cylinder 6. That is, when the stopper 7 is in a state of being mounted on the cosmetic container 100, the moving part 3 is left at the first stopping position, and the bottom face part 6*b* functions as a valve for closing the insertion hole 2*h*. In addition, since the seal part 6*d* is fitted to the receiving part 2*i*, the cosmetic A housed in the container main body 1 is sealed. Accordingly, the cosmetic A can be prevented from being carelessly discharged to the outside from the container main body 1 during conveying or storing of the cosmetic container 100.

Then, when the cosmetic container 100 starts to be used, the stopper 7 is removed in the state that the cap 11 is mounted on the cosmetic container 100 at first, and a user pushes the moving part 3 downward with force stronger than predetermined value. As a result, as illustrated in FIG. 6, the moving part 3 is moved to the second stopping position so as to abut against the container body 1, while the convex part 5*h* of the inner moving body 5 gets over the convex part 2*k* of the middle cylinder part 2 and enters into the concave part 2*g*. Then, the moving part 3 is made unmovable downward in the axial direction (the container main body side) by abutting against the container main body 1, and is made unmovable upward in the axial direction (the side opposite to the container main body side) by the convex part 5*h* and the convex part 2*k*. Therefore, the moving part 3 is left at the second stopping position.

When the moving part 3 is moved to the second stopping position, the discharge cylinder 6 protrudes downward by a predetermined length from the bottom face of the insertion hole 2*h*. In addition, the lower parts of the slits 6*c* are exposed from the insertion hole 2*h*. Accordingly, the container main body 1 comes to be in the state that the cosmetic A can pass through the slits 6*c* and the opening part 6*a*. That is, by moving of the moving part 3 to the second stopping position, the insertion hole 2*h* closed by the bottom face part 6*b* is opened (the valve is opened), and the cosmetic A sealed in the housing main body 1 can be discharged to the outside of the cosmetic container 100, through the slits 6*c*, the insides of the discharge cylinder, and the discharge cylinder opening part 6*a*. Further, after the moving part 3 is moved to the second stopping position, the cap 11 is removed from the cosmetic container 100. Then, the cosmetic container 100 can be ready to use.

Further, as illustrated in FIG. 3, when the moving part 3 is at the first stopping position after the stopper 7 is removed from the cosmetic container 100, a user can see a part of the middle cylinder part 2. However, as illustrated in FIG. 4, after the moving part 3 is moved to the second stopping position, the middle cylinder part 2 is concealed behind the moving part 3. Thus, a user determines, with the appearance of the cosmetic container 100, the state that moving part 3 is moved downward in the axial direction, so that the user can confirm the condition that the cosmetic container 100 is in a state capable of discharging the cosmetic A (that the discharge cylinder 6 protrudes downward by a predetermined length from the bottom face of the insertion hole 2*h*, and the slits 6*c* are exposed). Furthermore, when a part or the entirety of the container main body 1 is transparent, the user can directly, visually confirm whether or not the discharge cylinder 6 protrudes by a predetermined length from the bottom face of the insertion hole 2*h*.

In addition, the protruding length of the discharge cylinder 6 from the bottom face of the insertion hole 2*h* when the moving part 3 is moved to the second stopping position, can be such a length that the slits 6*c* are exposed and a proper amount of the cosmetic A can be discharged when a user uses the cosmetic container 100. Further, when the cap 11 is removed, the outer moving body 4 (the moving part 3) and the middle cylinder part 2 are connected to be unrotatable in the peripheral direction. In addition, the middle cylinder part 2 and the container main body 1 are connected to be unrotatable in the peripheral direction. Thus, even if a user holds the container main body 1 and rotates the cap 11 in the direction to cancel screwing, the moving part 3 and the middle cylinder 2 are not rotated synchronously with the cap 11, and the user can easily remove the cap 11 from the cosmetic container 100.

Further, for using cosmetic A, when the user pats and presses the application body 10 lightly toward a skin of a face or the like, the cosmetic A in the container main body 1 enters into the discharge cylinder 6 from the slits 6*c*, passes through the inside of the discharge cylinder 6, and goes from the opening part 6*a* to the application body 10. Then, the cosmetic A flows out through the elastic part 8 and the applicator 9 made of a porous material, which configure the coating applicator 10, and is applied. When the cosmetic A is applied, the elastic part 8 which is an elastic body is indirectly pressed toward the skin through the applicator 9, so that feeling in application can be improved. In addition, since the flocking is applied to the application face (surface) of the applicator 9 directly pressed toward the skin, user's feeling in application is more improved.

When the cosmetic A is applied, since the moving part 3 is left at the second stopping position, it can be prevented to cause a trouble that, while a user is using the cosmetic container 100, the moving part 3 is accidentally moved to the first stopping position so that a discharging amount of the cosmetic A varies or the cosmetic A is not discharged. Therefore, the cosmetic container 100 can discharge a constantly fixed amount of the cosmetic A.

Further, the outflow hole 8*a* for communicating between the opening part 6*a* and the applicator 9 is formed approximately in the center of the elastic part 8. The cosmetic A passes through the outflow hole 8*a* as a main passage, and flows out to the outside of the cosmetic container 100 through the applicator 9. Since the outflow hole 8*a* is provided at the elastic part 8 in this way, a significant amount of the cosmetic A can be introduced to an arbitrary portion on the face of the applicator 9, so that handleability for a user can be improved.

Further, the elastic part 8 is made of a porous material through which the cosmetic A can pass. Thus, of course, the cosmetic A can also pass through the inside of the elastic part 8 other than the outflow hole 8*a* and flow out the outside of the cosmetic container 100 through the applicator 9.

FIGS. 9 to 11 are views illustrating a discharge cylinder of a cosmetic container according to the second exemplary embodiment.

As a different point between the cosmetic container of the second exemplary embodiment and the cosmetic container of the first exemplary embodiment, the configuration of the discharge cylinder 6 is changed, and a discharge cylinder 16 is used instead of the discharge cylinder 6.

More specifically, the discharge cylinder 16 includes slits 16*c* only at a lower side portion of the discharge cylinder 6 (refer to FIG. 6), which protrudes downward from the insertion hole 2*h* and is exposed when the moving part 3 is moved to the second stopping position. In the second exemplary embodiment, the slits 16*c* are configured to include two openings along the peripheral direction and have an approximately rectangular shape which is horizontally long in a side view and is long in the peripheral direction.

According to the aforementioned configuration, when the moving part is moved to the second stopping position, an approximate entirety of the slits 16*c* of the discharge cylinder 16 protrude downward from the insertion hole 2*h* and are exposed. However, the effect is similar to that of the first exemplary embodiment, and the cosmetic container can discharge a proper amount of the cosmetic A when in use like the first exemplary embodiment.

Figure 12:
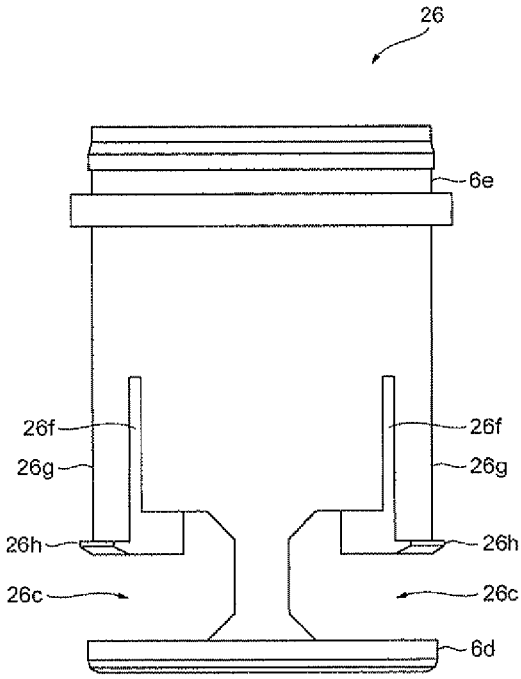
FIG. 12 is a front view illustrating a discharge cylinder of a cosmetic container according to a third exemplary embodiment of the present invention.
Figure 13:
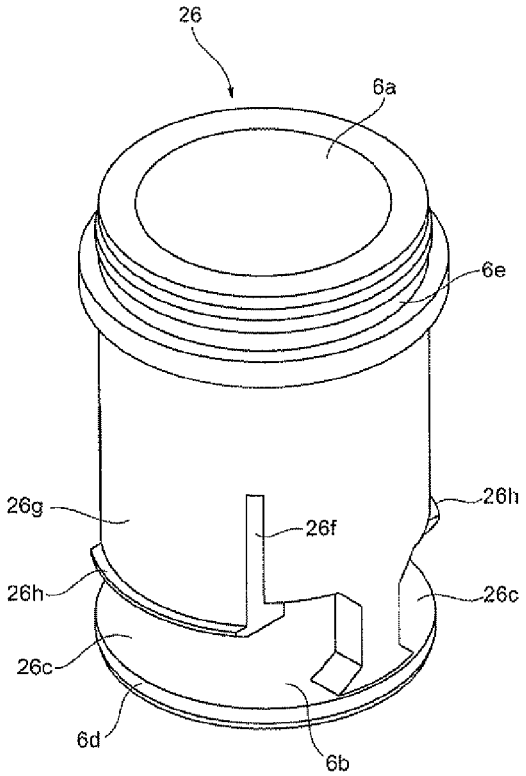
FIG. 13 is a perspective view of the discharge cylinder illustrated in FIG. 12 as viewed from the obliquely upper-left side.
Figure 14:
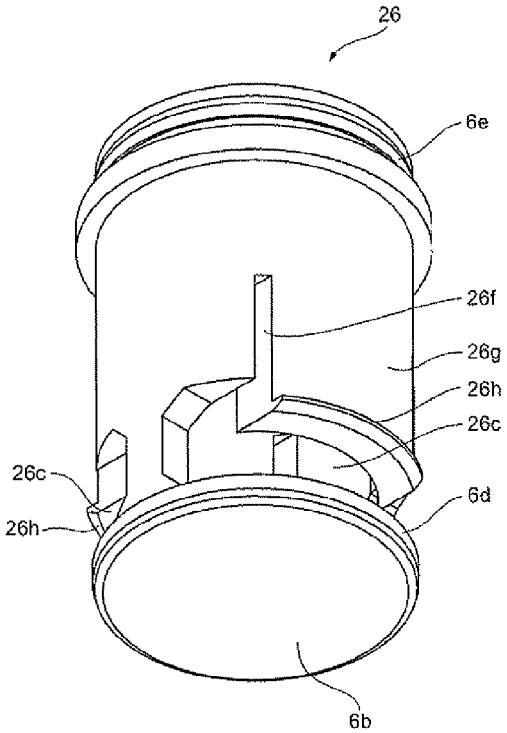
FIG. 14 is a perspective view of the discharge cylinder illustrated in FIG. 12 as viewed from the obliquely lower-right side.

FIGS. 12 to 14 are views illustrating a discharge cylinder of a cosmetic container according to the third exemplary embodiment of the present invention.

A discharge cylinder 26 of the third exemplary embodiment includes a plurality (two in the present exemplary embodiment) of slits 26*c* along the peripheral direction at a lower side face portion, where the slits 26*c* have an approximately rectangular shape which is horizontally long in a side view, and this shape is approximately similar to that of the slits 16*c* of the discharge cylinder 16 of the second exemplary embodiment. In addition, the discharge cylinder 26 includes slits 26*f* at the both sides in the peripheral direction of upper edges of the slits 26*c*, where the slits 26*f* extend upward for communicating of the inside and the outside and are vertically long in a side view. The discharge cylinder 26 has peripheral wall portions 26*g* having a circular arc sectional shape, which is surrounded by the slit 26*c* and the slits 26*f* and 26*f*, where the slit 26*c* has an approximately rectangular shape which is horizontally long in a side view and the slits 26*f* and 26*f* are vertically long in a side view.

The peripheral wall portions 26*g* are configured to be supported at upper ends thereof and have elasticity in the radial direction by the slits 26*f* and 26*f* at the peripheral both sides. Further, at lower ends of the peripheral wall portions 26*g*, pawl parts 26*h* are provided in a circular arc shape, and the pawl parts 26*h* protrude outward in the radial direction along the peripheral direction.

Figure 15:
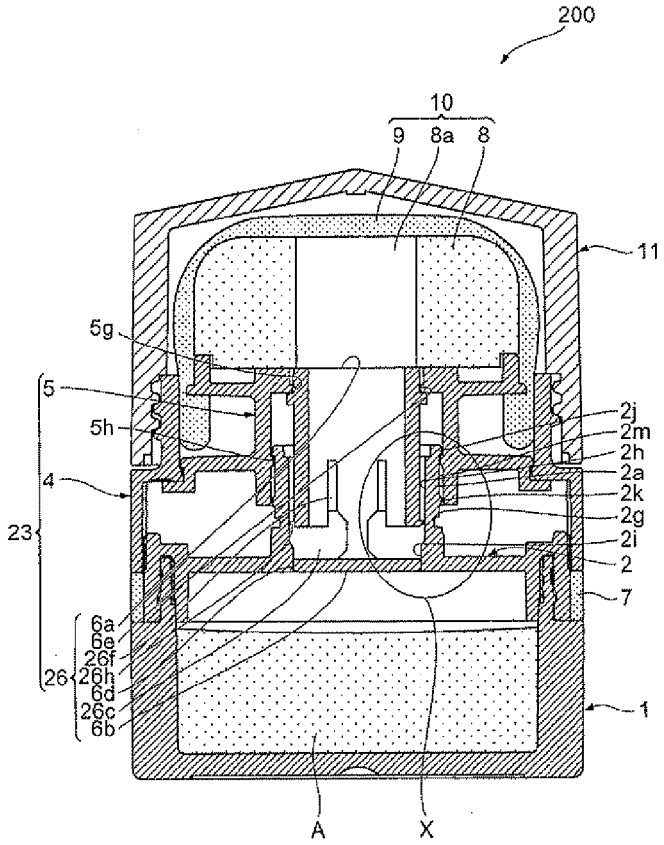
FIG. 15 is a longitudinal sectional view illustrating a cosmetic container according the third exemplary embodiment of the present invention to illustrate a state that the cosmetic container includes the discharge cylinder illustrated in FIGS. 12 to 14, and a cap and a stopper are mounted to the cosmetic container.
Figure 16:
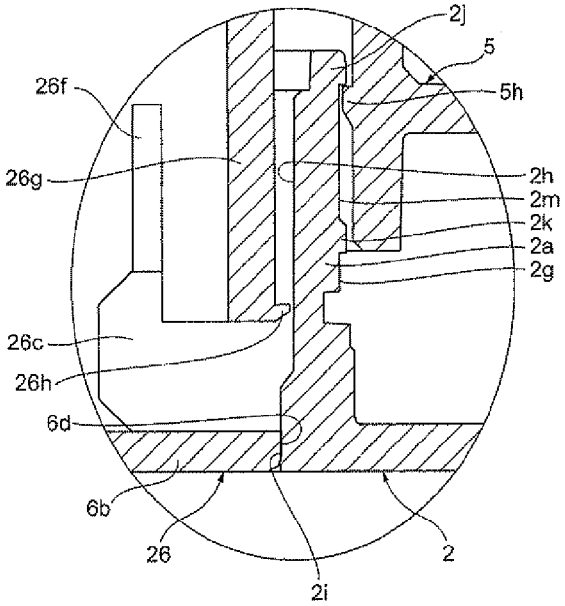
FIG. 16 is an enlarged view of the X part in FIG. 15.
Figure 17:
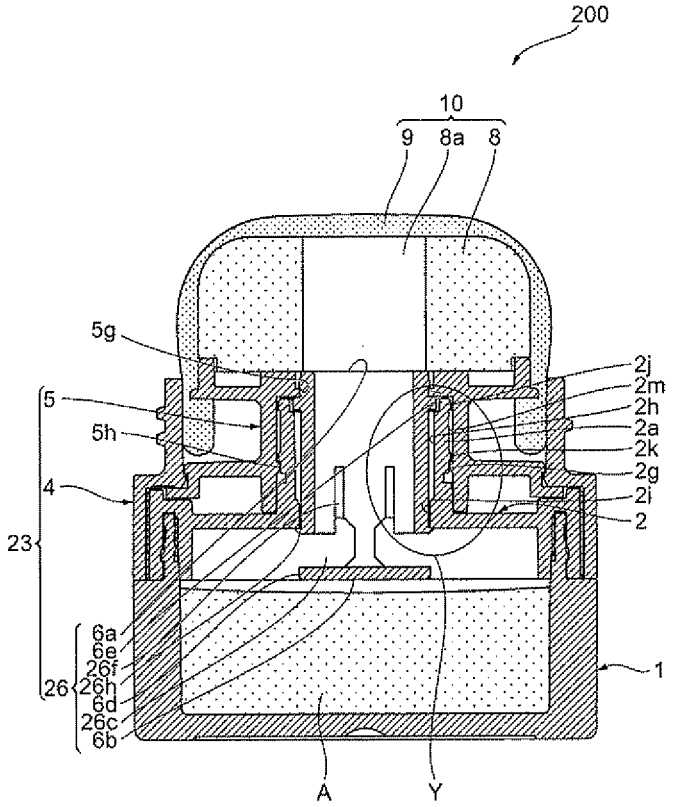
FIG. 17 is a longitudinal sectional view illustrating a state that the cap and stopper are removed from the state in FIG. 15, and a moving part is moved to a second stopping position.
Figure 18:
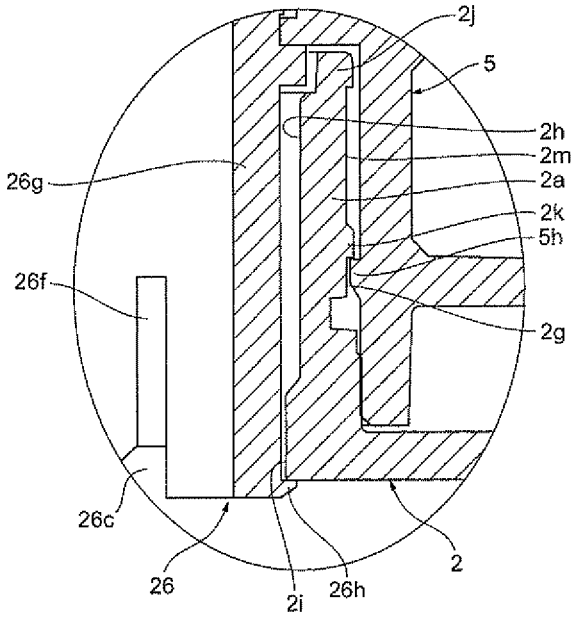
FIG. 18 is an enlarged view of the Y part in FIG. 17.

Then, the cosmetic container of the third exemplary embodiment having the discharge cylinder 26 illustrated in FIGS. 12 to 14 will be described below. FIG. 15 is a longitudinal sectional view illustrating the cosmetic container according to the third exemplary embodiment of the present invention when it is not used, and corresponds to FIG. 5. FIG. 16 is an enlarged view of an X part in FIG. 15. FIG. 17 is a longitudinal sectional view illustrating the cosmetic container illustrated in FIG. 15 when in use, and corresponds to FIG. 6. FIG. 18 is an enlarged view of a Y part in FIG. 17.

As illustrated in FIG. 15, in a cosmetic container 200, the discharge cylinder 26 is used instead of the discharge cylinder 6 of the first exemplary embodiment. As illustrated in FIGS. 15 and 16, like the first exemplary embodiment, the seal part 6*d* on an outer periphery of a bottom part of the discharge cylinder 26 is fitted to the receiving part 2*i* at a cylinder hole lower part of the middle cylinder part 2, and the cosmetic A cannot pass through between them. In this configuration, the pawl parts 26*h* of the discharge cylinder 26 are arranged at an intermediate position in the axial direction of the communication hole 2*h* in the middle cylinder part 2 so as to be close to the inner peripheral face of the communication hole 2*h*, as particularly illustrated in FIG. 16. The other configuration of the cosmetic container 200 is similar to that of the first exemplary embodiment.

Further, the cosmetic container 200 is configured with a moving part 23 like the first exemplary embodiment. The moving part 23 includes the outer moving body 4, the inner moving body 5, and the discharge cylinder 26 of the present exemplary embodiment, where the outer moving body 4 and the inner moving body 5 are the same as those in the first exemplary embodiment.

In the cosmetic container 200 configured as above, when a user moves the moving part 23 from a first position illustrated in FIG. 15 to a second stopping position illustrated in FIGS. 17 and 18, the cosmetic container works as follows. When the moving part 23 is moved to the second stopping position, more particularly, when the pawl parts 26*h* of the discharge cylinder 26 pass downward in the receiving part 2*i* having a smaller diameter than other hole diameters of the middle cylinder part 2, the pawl parts 26*h* bend to the inner side in the radial direction. Then, when the moving part 23 is positioned at the second stopping position as illustrated in FIG. 17, the pawl parts 26*h* pass over the receiving part 2*i*, elastically return to the original position, and are hooked onto the bottom face of middle cylinder part 2 to be engaged in the axial direction as especially illustrated in FIG. 18. Accordingly, the moving part 23 comes to be unmovable to the side opposite to the container main body side (upward in the axial direction).

Further, in the aforementioned state, an approximate entirety of the slits 26*c* of the discharge cylinder 26 protrude downward from the insertion hole 2*h* and are exposed, like the second exemplary embodiment. Thus, the cosmetic container 200 can discharge a proper amount of the cosmetic A when in use, like the first and second exemplary embodiments.

In addition, only by engaging of the pawl parts 26*h* with the bottom face of the middle cylinder part 2, the moving part 23 can be made unmovable to the side opposite to the container main body side. Further, the pawl parts 26*h* can be made to function as an auxiliary for engaging of the convex part 5*h* of the inner moving body 5 with the convex part 2*k* of the middle cylinder part 2, where the engagement is described in the first exemplary embodiment. Furthermore, engaging by the pawl parts 26*h* can be made to function as a main engagement, while engaging by the convex part 5*h* of the inner moving body 5 with the convex part 2*k* of the middle cylinder part 2 is made to function as an auxiliary engagement.

Accordingly, the present invention has been described in detail based on the exemplary embodiments. However, the present invention is not limited in the aforementioned exemplary embodiments. For example, the moving part includes three members of the outer moving body, inner moving body, and the discharging cylinder. However, these members can be formed integrally, and thus the moving part can be formed by one member.

Further, the shape of the slits 6C are configured to be an approximately rectangular shape which is vertically long in a side view and the shapes of the slits 16*c* and 26*c* are configured to be approximately rectangular shapes which are horizontally long in a side view. However, the shapes are not limited to the approximately rectangular shape. For example, the shapes can be an elliptical shape in a side view, a diamond shape, or the like, if it can pass the cosmetic A.

Furthermore, the outflow hole 8*a* of the elastic part 8 has an approximately equal diameter to the diameter of the discharge cylinder 6, 16 or 26, and has a larger diameter than that of the opening part 6*a* of the discharge cylinder 6, 16 or 26. In addition, the outflow hole 8*a* is provided in a columnar shape above the discharge cylinder 6, 16 or 26. However, the diameter and the shape of the outflow hole 8*a* are not limited to these diameter and shape if the outflow hole 8*a* has a shape which permits communicating between the opening part 6*a* and the applicator 9. A plurality of outflow holes 8*a* can be provided. For example, the diameter of the outflow hole 8*a* can be smaller than that of the opening part 6*a*, or can be larger than the diameter illustrated in the figures. Further, the shape of outflow hole 8*a* can be a triangular cylindrical shape, a quadrangular cylindrical shape or the like, and a plurality of the outflow holes 8*a* having these shapes can be provided. Furthermore, a plurality of the outflow holes 8*a* can be radially provided from the opening part 6*a* toward the applicator 9.

What is claimed is:

1. A cosmetic container comprising:

a container main body to house a cosmetic;

a moving part comprising a cylindrical discharge cylinder which has an opening part opened at one end in an axial direction, a closing part closed at the other end in the axial direction, and slits in the side face, and wherein the cosmetic housed in the container main body can be discharged from the opening part, after passing through the slits;

the moving part further comprising an outer moving body and an inner moving body positioned on an inner side of the outer moving body, and wherein the discharge cylinder is positioned on an inner side of the inner moving body such that the outer and inner moving bodies and the discharge cylinder can be moved identically in the axial direction;

a middle cylinder part comprising an insertion hole into which the discharge cylinder can be inserted; and an application body which covers the opening part of the discharge cylinder and can make the cosmetic to flow out to the outside, wherein the moving part has a configuration that, in a state of the discharge cylinder being inserted into the insertion hole of the middle cylinder part, the moving part is movable from a first stopping position to a second stopping position separating in the axial direction and is left at the second stopping position, wherein, when the moving part is positioned at the first stopping position, the closing part of the discharge cylinder closes the insertion hole of the middle cylinder part, and wherein, when the moving part is positioned at the second stopping position, the discharge cylinder protrudes by a predetermined length from an end face of the insertion hole, so that the cosmetic can be discharged to the application body from the opening part, after passing through the slits in the side face of the discharge cylinder.

2. The cosmetic container as claimed in claim 1, wherein, at the second stopping position, the moving part abuts against the container main body and comes to be unmovable to the container main body side, and engages with the middle cylinder part in the axial direction and comes to be unmovable to the side opposite to the container main body side, so that the moving part is left at the second stopping position.

3. The cosmetic container as claimed in claim 2, wherein the discharge cylinder comprises pawl parts on an outer peripheral face thereof, wherein, when the moving part is moved to the second stopping position, the pawl parts are bent inside, and when the moving part is positioned at the second stopping position, the pawl parts elastically return to the original position, and are hooked onto a bottom face of the middle cylinder part, so that the moving part is engaged in the axial direction and comes to be unmovable to a side opposite to the container main body side.

4. The cosmetic container as claimed in any one of claims 1 to 3, wherein the cosmetic container further comprises:

a stopper detachably mounted so as to be inserted between the moving part and the container main body in the axial direction, and wherein, since the stopper is mounted, the moving part is unmovable to the container main body side and can be left at the first stopping position.

5. The cosmetic container as claimed in any one of claims 1 to 3, wherein the moving part comprises a moving part-side rotation stopper, and the middle cylinder part comprises a middle cylinder part-side rotation stopper, and wherein the moving part engages with the middle cylinder part so as to be unrotatable in the peripheral direction by the moving part-side rotation stopper and the middle cylinder part-side rotation stopper.

6. The cosmetic container as claimed in claim 4, wherein the moving part comprises a moving part-side rotation stopper, and the middle cylinder part comprises a middle cylinder part-side rotation stopper, and wherein the moving part engages with the middle cylinder part so as to be unrotatable in the peripheral direction by the moving part-side rotation stopper and the middle cylinder part-side rotation stopper.

7. The cosmetic container as claimed in claim 1, wherein the application body is mounted on the moving part.

8. The cosmetic container as claimed in claim 7, wherein the application body comprises an elastic part and an applicator mounted to the moving part.

9. The cosmetic container as claimed in claim 8, wherein a lower part of the applicator is inserted between the inner moving body and the outer moving body.

* * * * *